US012312046B2

(12) United States Patent
Malec

(10) Patent No.: US 12,312,046 B2
(45) Date of Patent: May 27, 2025

(54) SYSTEM AND METHOD FOR CREATING STORAGE ON A MARINE VEHICLE

(71) Applicant: Ronald C Malec, Foley, AL (US)

(72) Inventor: Ronald C Malec, Foley, AL (US)

( * ) Notice: Subject to any disclaimer, the term of this patent is extended or adjusted under 35 U.S.C. 154(b) by 508 days.

(21) Appl. No.: 17/872,219

(22) Filed: Jul. 25, 2022

(65) Prior Publication Data

US 2023/0069013 A1 Mar. 2, 2023

Related U.S. Application Data

(60) Provisional application No. 63/237,983, filed on Aug. 27, 2021.

(51) Int. Cl.
*B63B 25/00* (2006.01)
*B63B 21/04* (2006.01)
*B63C 11/02* (2006.01)

(52) U.S. Cl.
CPC ..... *B63B 25/002* (2013.01); *B63B 21/04* (2013.01); *B63C 11/02* (2013.01)

(58) Field of Classification Search
CPC ..... B63B 25/00; B63B 25/002; B63B 21/00; B63B 21/04; B63C 11/00; B63C 11/02
USPC ..... 114/218, 343, 364
See application file for complete search history.

(56) References Cited

U.S. PATENT DOCUMENTS 5,673,507 A * 10/1997 Stokes, Jr. ..... B63C 11/02 114/364
6,289,627 B1 * 9/2001 Gibbs ..... A01K 97/10 43/21.2
6,487,984 B1 * 12/2002 Pape ..... B63B 21/045 114/218
7,302,900 B1 * 12/2007 Stefano ..... B63B 21/04 114/364
9,932,094 B1 * 4/2018 Santeiro ..... B63C 11/02

* cited by examiner

*Primary Examiner* — Lars A Olson
(74) *Attorney, Agent, or Firm* — AdamsIP, LLC; Edward Brinkley Garner, III; James Hunter Adams

(57) ABSTRACT

A system for creating additional storage on a marine vehicle is provided. The system of the present disclosure is generally designed to secure to a marine vehicle via a rod holder, wherein parallel bars provide additional storage area for marine equipment, such as innertubes. To this end, the system of the present disclosure may comprise supports and support braces. Straps may be used to attach the marine equipment to the supports. To ensure that the supports are properly secured within the rod holders, a sleeve may be used to increase friction and change size. Board arms may be attached to the supports in order to increase storage area.

20 Claims, 5 Drawing Sheets

SYSTEM AND METHOD FOR CREATING STORAGE ON A MARINE VEHICLE

CROSS REFERENCES

This claims priority to U.S. Provisional Application Ser. No. 63/237,983, filed on Aug. 27, 2021, in which said application is incorporated herein in its entirety by reference.

FIELD OF THE DISCLOSURE

The subject matter of the present disclosure refers generally to a system and method for creating additional storage on a marine vehicle.

BACKGROUND

Many marine vehicles have a lack of storage. This has been a problem for years with very few viable solutions being provided to solve said problem. This is particularly an issue for those who own a single marine vehicle that they use for multiple marine activities. Many recreational fishing boats are suitable for marine activities other than fishing, but besides the fishing pole holders mounted about recreational fishing boats, storage can be lacking. This is readily apparent when performing the marine activity of tubing, wherein a large innertube is pulled by a marine vehicle at high speeds. However, though the innertube is pulled behind the marine vehicle during the activity, it often isn't desirable to pull the innertube until a desired location has been reached. Carrying these innertubes in the marine vehicle really limits available room for passengers of a boat while simultaneously reducing space that might be used for other equipment, such as coolers.

Drink holders and fishing pole holders are often located on gunnels of marine vehicles, creating natural anchor points that might be used for storage. However, many current storage solutions for marine vehicles require permanent attachment to various points about said marine vehicle. This essentially forces owners of marine vehicles to choose which marine activity their marine vehicle will be optimized to do since putting a large storage rack around the perimeter of a marine vehicle might seriously hamper an owner's ability to use said marine vehicle for fishing. Further, these storage solutions are often bulky and themselves not easy to store when not in use. These inconveniences make it less likely that owners of marine vehicles will use said solutions since the time and effort to modify the marine vehicle is often not worth the inconvenience. Nor is the cost of these more permanent solutions something many owners of marine vehicle may want to pay.

Accordingly, there is a need in the art for a modular system that allows one to create storage using fishing pole holders as a mounting point so that recreational equipment can be more easily transported.

SUMMARY

A system for modular storage that can be used to create additional storage for recreational equipment used for marine activities is provided. In one aspect, the system converts storage for one type of equipment to storage for another type of equipment. In another aspect, the system is designed to allow a user to convert a plurality of fishing rod holders into a support rack, wherein said support rack is also designed to break down so that the rod holders may be used for their intended purpose when said support rack is not needed. Generally, the system is designed to create storage space on marine vehicles for recreational equipment, such as floats.

The system of the present disclosure may comprise a support configured to secure to a rod holder. Parallel bars of the support extend horizontally from the rod holder to create additional storage space. Multiple supports may be placed in multiple rod holders to create a collection of parallel bars that may be used together to support larger marine/recreational equipment. Straps of the support may secure marine equipment thereto. A holding post of the support secures the support within the rod holder. In some embodiments, a brace may be used to connect two or more supports in order to increase structural stability. In other preferred embodiments, hinges may be used to decrease the footprint of the support when not in use. The hinges may also increase the support's ability to conform to the shape of a marine vehicle. In yet other embodiments, a buffer of the support may prevent the support from damaging the marine vehicle. Additionally, a board arm may be connected to two or more supports to increase storage functionality.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
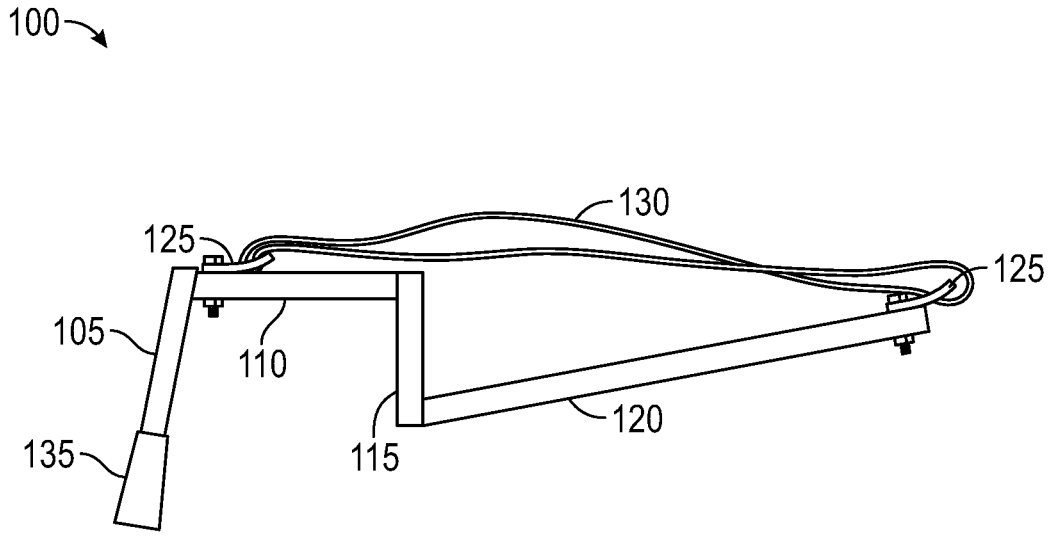
FIG. 1 illustrates a support embodying features consistent with the principles of the present disclosure.
Figure 2:
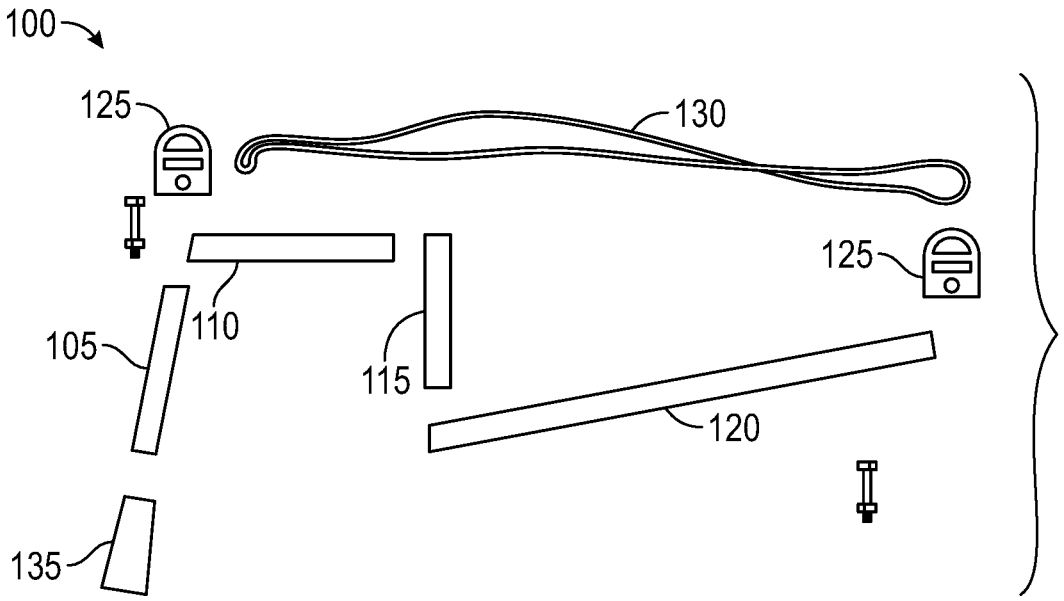
FIG. 2 illustrates a support embodying features consistent with the principles of the present disclosure.
Figure 3:
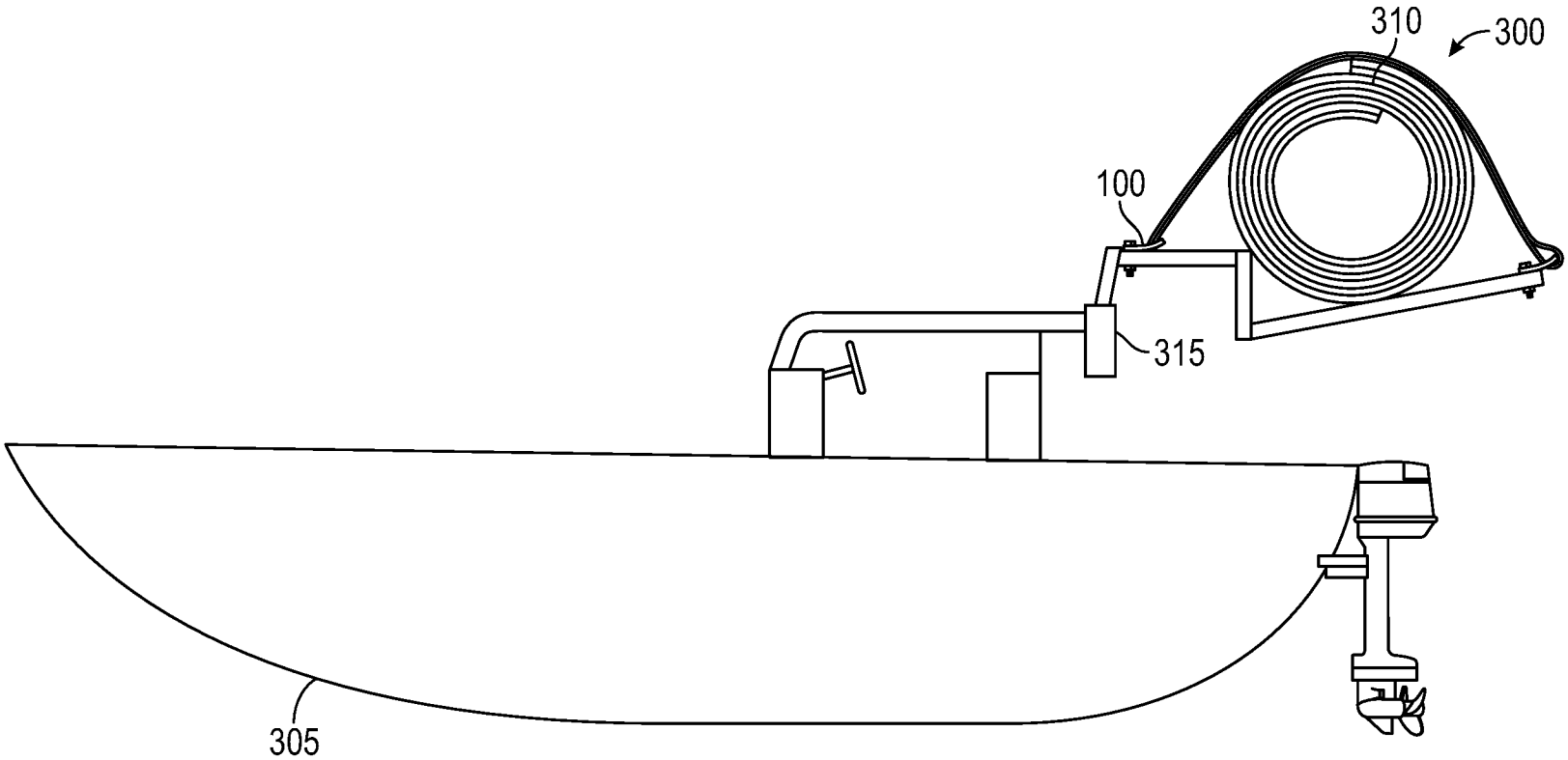
FIG. 3 illustrates an environmental view of supports embodying features consistent with the principles of the present disclosure disposed within a fishing rod holder and supporting marine equipment.
Figure 4:
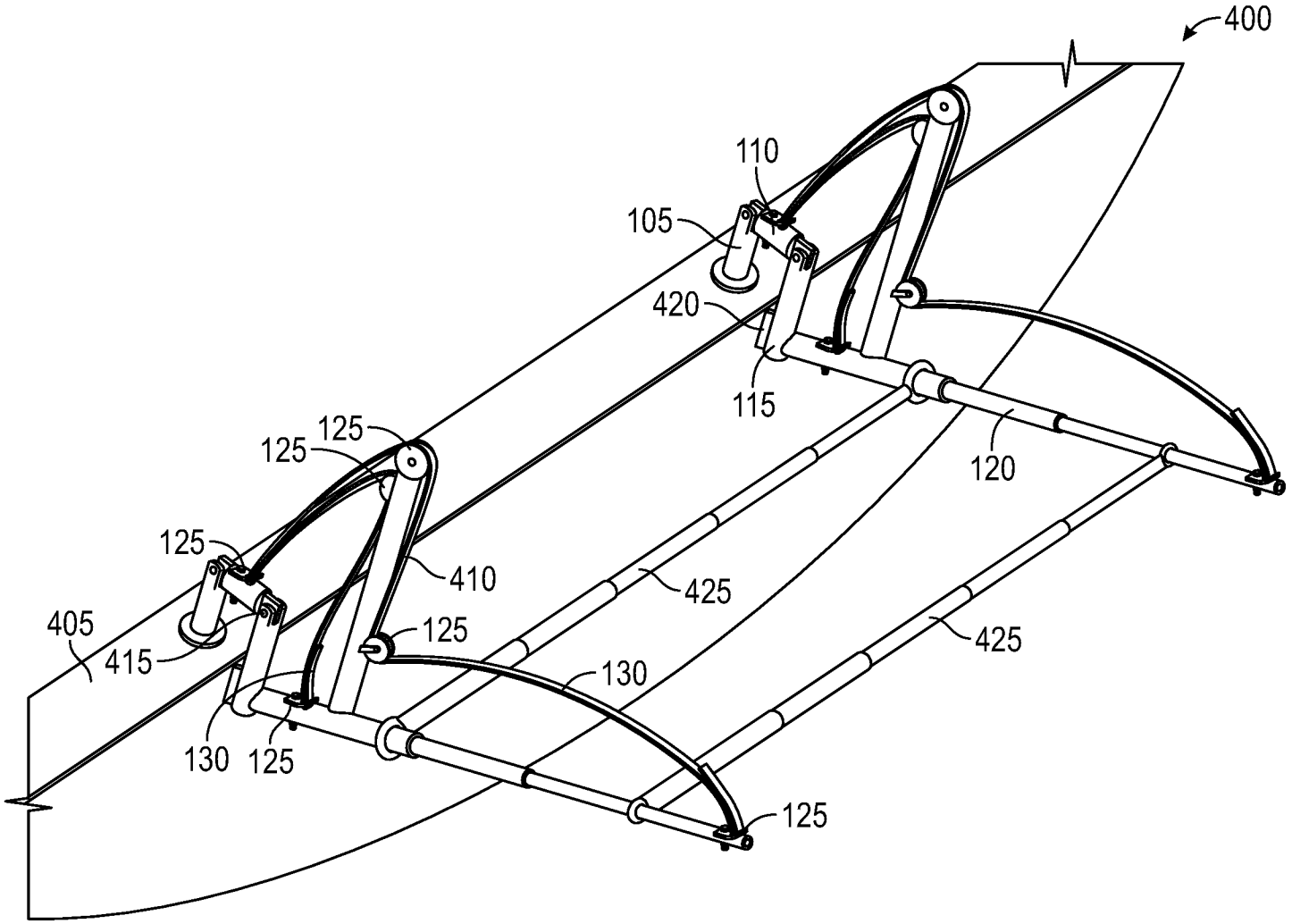
FIG. 4 illustrates a perspective view of a system embodying features consistent with the principles of the present disclosure.
Figure 5:
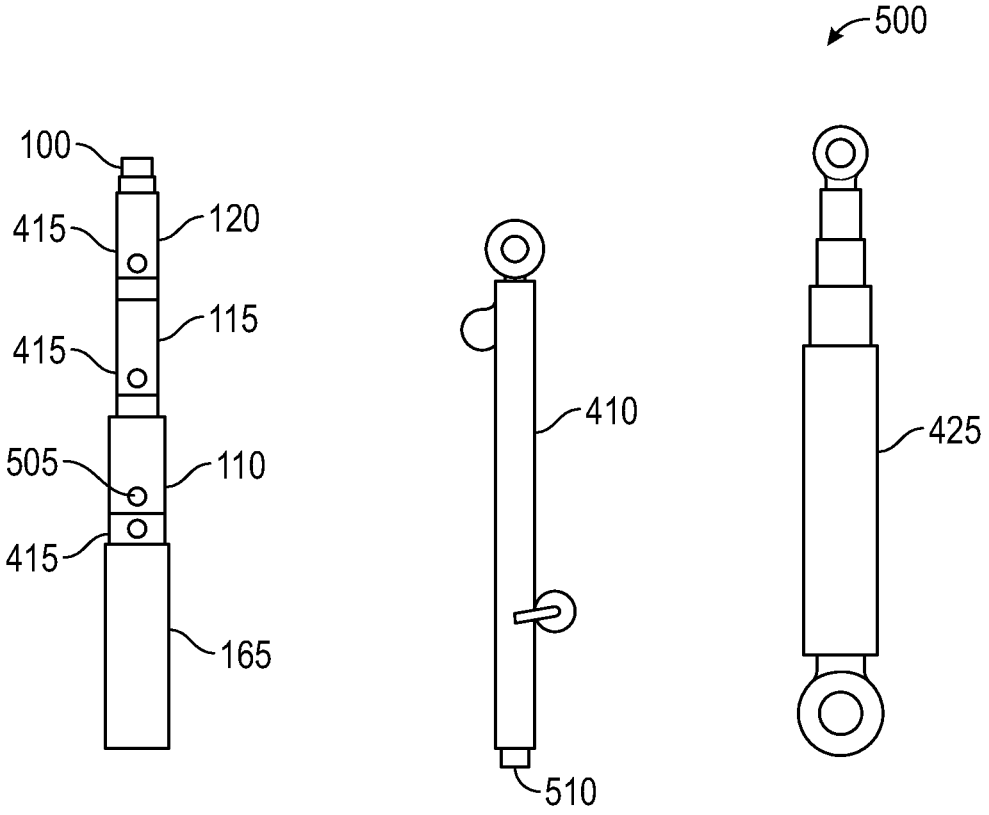
FIG. 5 illustrates a system embodying features consistent with the principles of the present disclosure.

FIGS. 1-5 illustrate preferred embodiments of a system 500 for modular storage that can be used to create additional storage for recreational equipment used for marine activities. FIG. 1 illustrates a support 100 used to create/convert storage space on a marine vehicle 305. FIG. 2 illustrates an exploded view of a support 100 used to create/convert storage space on a marine vehicle 305. FIG. 3 illustrates a side environmental view of supports 100 used in an environment 300, wherein said supports 100 may be used to mount marine equipment 310 in an overhead manner using rod holders 315 secured to the center console. FIG. 4 illustrates a perspective view of a system 500 used to mount marine equipment 310 using rod holders 315 secured to the gunnel of a marine vehicle 305. FIG. 5 illustrates a system 500 used to create storage on marine vehicles 305.

The system 500 generally comprises two or more supports 100 configured in a way such that they may be secured in two or more rod holders 315, wherein parallel bars of the two or more supports 100 extend horizontally from said two or more rod holders 315 to create additional storage space. A brace 425 may be used to connect two or more supports 100 in order to increase structural stability. In other embodiments, a board arm 410 may be connected to a support 100 to increase storage functionality. The rod holders 315 of the marine vehicle 305 are preferably spaced from one another in a way such that the distance between a plurality of supports 100 positioned within said rod holders 315 is short enough so that marine equipment 310 may contact two or more supports 100. In a preferred embodiment, the rod holders 315 are located on the gunnel 405 of a marine vehicle 305, as illustrated in FIG. 4, but the rod holders 315 may be located elsewhere on the marine vehicle 305 without departing from the inventive subject matter described herein, as illustrated in FIG. 3. Straps 130 of the supports 100, brace 425, and board arm 410 may be used to secure recreational equipment thereto.

In a preferred embodiment, a support 100 comprises a holding rod 105, first parallel bar 110, second parallel bar 120, and connecting rod 115. Types of materials that may be used to create the support 100 include, but are not limited to aluminum, steel, polymer, carbon fiber, or any combination thereof. The holding post is configured to fit within a rod holder 315 of a marine vehicle 305. As illustrated in FIGS. 1 and 2, the holding post is shaped to fit within a rod holder 315 of the marine vehicle 305; however, it is understood that the holding post may comprise other shapes without departing from the inventive subject matter described herein. For instance, a holding post may be shaped to fit a standard cup holder. The length of the holding post is preferably long enough that a holder end of the holding post contacts the bottom of the rod holder 315. Some preferred embodiments of a holding post may further comprise a sleeve 135 configured to removably attach to said holding rod 105. The rubber sleeve 135 may comprise different sizes, allowing the holding post to fit multiple sizes of rod holders 315. For instance, a user may remove a first sleeve 135 that is too large for the current rod holder 315 and attach a second sleeve 135 that first said rod holder 315. For instance, a user may attach a rubber sleeve 135 to the holding post to provide more grip for said holding post within said rod holder 315.

The holding post is connected to the first parallel bar 110 at a first end of the first parallel bar 110. In a preferred embodiment, the angle created between the holding post and first parallel bar 110 is such that the first parallel bar 110 is positioned on or near the top of a gunnel 405 of a marine vehicle 305 when said holding post is positioned within the rod holder 315. For instance, the length of the holding post and angle created between the holding post and first parallel bar 110 may be configured such that the first parallel bar 110 is positioned above the gunnel 405 of a marine vehicle 305 by one foot or less. The connecting rod 115 is preferable attached to the second end of the first parallel bar 110 and oriented in a direction that is generally downward when the holding post is positioned within the rod holder 315. In a preferred embodiment, the angle created by the first parallel bar 110 and the connecting rod 115 is such that the connecting rod 115 rests on or near the exterior surface of the marine vehicle 305. For instance, the length of the first parallel bar 110 and angle created between the first parallel bar 110 and holding rod 105 may be configured such that the connecting rod 115 is positioned beside the exterior of a marine vehicle 305 by one foot or less.

Some preferred embodiments of a first parallel bar 110 and/or connecting rod 115 may further comprise a buffer 420 positioned such that it inhibits the first parallel bar 110 and/or connecting rod 115 from directly contacting the marine vehicle 305, reducing the likelihood that the rigid first parallel bar 110 and/or connecting rod 115 will damage said marine vehicle 305 when connected thereto. Types of material that may be used as the buffer 420 include, but are not limited to, silicon, rubber, foam, or any combination thereof. In a preferred embodiment, the buffer 420 comprises rubber, which may provide a friction force that may reduce movement of the support 100 while the marine vehicle 305 is in motion. For instance, a foam and neoprene pad having a plurality of textured rubber pads on an exterior surface may be used to prevent damage to the marine vehicle 305 while simultaneously providing friction force that may prevent the support 100 from moving while said marine vehicle 305 is in motion.

The second parallel bar 120 is connected to said connecting rod 115 at a second connector end of said connecting rod 115 and provides a platform on which a user may secure marine equipment 310. In a preferred embodiment, the second parallel bar 120 is connected to the connecting rod 115 generally perpendicularly. In another preferred embodiment, the second parallel bar 120 is connected to the connecting rod 115 such that the second parallel bar 120 is angled slightly away from the water when the marine vehicle 305 is upright in the water and when the holding post is positioned within a rod holder 315 of said marine vehicle 305, as illustrated in FIG. 3. Therefore, a plurality of angles may be formed between said second parallel bar 120 and said connecting rod 115, depending on the structure formed by the holding rod 105, first parallel bar 110, and connecting rod 115. In a preferred embodiment, the second parallel bar 120 has a length great enough to accept a float when two or more supports 100 are positioned relative to one another on a marine vehicle 305 within two or more rod holders 315. For instance, the second parallel bar 120 of three supports 100 connected to a marine vehicle 305 is preferably forty to sixty inches in order to hold an average diameter size innertube used for tubing.

A strap 130 of the support 100 may be used to secure marine equipment 310 thereto. Materials that may be used to construct the strap 130 include, but are not limited to, nylon, rayon, polyester, polypropylene, rubber, or any combination thereof. Buckles 125 may be used to in combination with the strap 130 in order to secure marine equipment 310 to said support 100. In a preferred embodiment, a first buckle 125 of the first parallel bar 110 and a second buckle 125 of the second parallel bar 120 may be arranged on said first parallel bar 110 and said second parallel bar 120 so that marine equipment 310 may be secured to the top side of the support 100. In another preferred embodiment, a third buckle 125 located between said first buckle 125 and said second buckle 125 may be used in conjunction with said second buckle 125 to allow a strap 130 to secure marine equipment 310 to said support 100 therebetween. In some embodiments, a second strap 130 may be used to secure marine equipment 310 between said second buckle 125 and said third buckle 125. Types of buckles 125 that may be used with the strap 130 include, but are not limited to, cam buckles 125, ratchet buckles 125, roller buckles 125, side-release buckles 125, slide buckles 125, snap buckles 125, or any combination thereof. In one preferred embodiment, the strap 130 and buckle 125 comprise a bungee cord and bungee attachment point, such as a hook or a U-bolt.

As mentioned previously, two or more supports 100 may be used in conjunction with one another to create a support rack 400, wherein marine equipment 310 may be secured to said supports 100 of said support rack 400. For instance, as illustrated in FIG. 4, a first support and second support may be secured to said marine vehicle 305 via a first rod holder 315 and second rod holder 315 to create said support rack 400, wherein said first support and said second support are generally oriented parallel to one another. A piece of marine equipment 310 may then be placed on the support rack 400 and secured using the straps 130 of the first support and second support. As such, some preferred embodiments of a support rack 400 may further comprise a brace 425 that may be used to secure the first support and second support to one another. In a preferred embodiment, the brace 425 is configured to attach to the second parallel bars 120 of the two or more supports 100.

In some preferred embodiments, at least one of the holding rod 105, first parallel bar 110, second parallel bar 120, connecting rod 115, and brace 425 may be adjustable. In one such embodiment, at least one of the holding rod 105, first parallel bar 110, second parallel bar 120, connecting rod 115, and brace 425 is configured to extend in length. This may allow the support 100 to fit multiple marine vehicles 305 and marine equipment 310 of varying sizes as well as allow for a user to create support racks 400 from supports 100 positioned within rod holders 315 at varying distances. In one such embodiment, the holding rod 105, first parallel bar 110, second parallel bar 120, connecting rod 115, and brace 425 may be partially or fully telescopic. Users may lock the holding rod 105, first parallel bar 110, second parallel bar 120, connecting rod 115, and brace 425 into a desired position using a locking element and, in some embodiments, an at least one aperture of the holding rod 105, first parallel bar 110, second parallel bar 120, connecting rod 115, and brace 425. Apparatuses that may act as the locking element include, but are not limited to, push-pull pins, clamps, set knobs, snap locks, spring buttons, and clutch locks, or any combination thereof.

Some preferred embodiments of the support 100 may also comprise at least one rotating mechanism, allowing the even more of a custom fit to a marine vehicle 305 as well as giving the user the option to reduce the profile of the support 100 when not in use, making it easier to store. In a preferred embodiment, the rotating mechanism comprises hinges 415 and pivots. For instance, the holding post may be rotatably attached to the first parallel bar 110 via a hinge 415 such that the holding post may be folded in a generally parallel position relative to said first parallel bar 110 when not in use. For instance, the first parallel bar 110 may be rotatably attached to the connecting rod 115 via a stop hinge 415 such that the first parallel bar 110 may be folded in a generally parallel position relative to said holding post when not in use. For instance, the holding post may be rotatably attached to the second parallel bar 120 via a pivot hinge 415 such that the holding post may be folded in a generally parallel position relative to said second parallel bar 120 when not in use.

By using a plurality of hinges 415, a user may fold a support 100 into a much smaller profile as illustrated in FIG. 5. In one preferred embodiment, hinges 415 are configured such that the various pieces of the support 100 may only rotate about one another until a mechanical limit is reached. For instance, the first parallel bar 110 and connecting rod 115 may be rotatably attached via a hinge 415 that will not allow an angle of greater than 120 degrees when fully extended. In other preferred embodiments, the hinges 415 may comprise locking elements, which may be used to increase friction of the hinge 415 to make the various pieces of the support 100 more difficult to rotate about said hinge 415. For instance, a torquing hinge 415 comprising a wing nut may be used to rotatably attach the holding post to the first parallel bar 110, allowing a user to adjust the resistance of the hinge 415 via the wing nut.

In another preferred embodiment, a flag holder of the support 100 may be used to secure a flag to the marine vehicle 305. The flag holder is preferably situated on said support 100 such that a flag placed in said flag holder is situated in an upright position. In some preferred embodiments, the flag holder may be moveably attached to the support 100, allowing a user to orient the flag holder in a way that changes the orientation of the flag when placed in said flag holder. For instance, a user may rotate a flagpole holder about said support 100 via a pivot hinge 415, wherein a locking element of said pivot hinge 415 allows a user to adjust friction of the pivot hinge 415 to prevent the flagpole holder from rotating about said support 100 when said flagpole holder reaches a desired orientation. Therefore, users may secure the holding rod 105 to the marine vehicle 305 via the rod holder 315 and orient the various pieces of the support 100 as described herein without having to worry about the orientation of the flag holder since said user can subsequently adjust it as needed.

In yet another preferred embodiment, a board arm 410 may be attached to at least one of said first parallel bar 110 and said second parallel bar 120. In a preferred embodiment, the board arm 410 is oriented in a vertical direction when said support 100 is secured to said marine vehicle 305. A strap 130 of said board arm 410 may be used to secure marine equipment 310 thereto. In some preferred embodiments, a buckle 125 of said board arm 410 may be used to secure said marine equipment 310 in conjunction with a buckle 125 of said support 100, as illustrated in FIG. 4. In a preferred embodiment, the board arm 410 is removably attached to one of the first parallel bar 110 and second parallel bar 120 via a threaded male section 510 located on the bottom end of the board arm 410 and a threaded female section 505 of said first parallel bar 110 and second parallel bar 120. The threads are preferably in a parallel orientation but may be tapered or a combination of tapered and parallel without departing from inventive subject matter described herein. Alternatively, the board arm 410 may be removably attached to the second parallel bar 120 via an attachment element. For instance, said bottom end of said board arm 410 may be configured such that it may fit around and slide about the second parallel bar 120. A locking pin may then be used to secure the board arm 410 to the second parallel bar 120 via apertures of the board arm 410 and parallel bar. By aligning these apertures, a user may push a pin therethrough and secure the board arm 410 and second parallel bar 120 to one another.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter can be made without departing from the principles and scope of the inventive subject matter.

What is claimed is:

1. A system for marine vehicle storage comprising,
- a holding post configured to fit within a rod holder,
  - wherein said rod holder is in a generally upright position,
- a first parallel bar mounted to said holding post at a holder end,
  - wherein said first parallel bar extends laterally away from said holding post,
- a connecting rod connected to said first parallel bar at a first connector end of said connecting rod,
  - wherein said connecting rod extends in a generally downward direction away from said first parallel bar,
- a second parallel bar connected to said connecting rod at a second connector end,
  - wherein said second parallel bar extends laterally away from said connecting rod, and
- a strap configured to hold equipment on said first parallel bar, connecting rod, and second parallel bar,
  - wherein said strap is secured to said first parallel bar and said second parallel bar.

2. The system of claim 1, further comprising a sleeve configured to fit said holding post,
- wherein said sleeve is adjustable such that a size adjusts to fit said rod holder.

3. The system of claim 1, further comprising a buffer secured to said connecting rod and positioned between said connecting rod and said holding post.

4. The system of claim 1, wherein said first parallel bar and said second parallel bar are generally parallel to one another.

5. The system of claim 1, wherein at least one of said first parallel bar and said second parallel bar are telescoping.

6. The system of claim 1, further comprising at least one hinge on at least one said holding post, first parallel bar, connecting rod, and second parallel bar.

7. The system of claim 1, further comprising a board arm,
- wherein said board arm extends in a generally upward direction away from said second parallel bar,
- wherein said board arm is generally perpendicular to said second parallel bar.

8. The system of claim 7, further comprising a plurality of buckles configured to secure said strap to at least one of said first parallel bar, connecting rod, second parallel bar, and board arm.

9. The system of claim 1, further comprising a brace having a first end and a second end,
- wherein said first end and said second end each secure one of said second parallel bar.

10. A system for marine vehicle storage comprising,
- a first support comprising,
  - a first holding post configured to fit within a first rod holder,
  - a first parallel bar mounted to said first holding post at a holder end,
  - a first connecting rod connected to said first parallel bar at a first connector end of said first connecting rod,
  - a second parallel bar connected to said first connecting rod at a second connector end,
  - a first strap,
    - wherein a first buckle of said first parallel bar and a second buckle of said second parallel bar allow said first strap to be secured to said first parallel bar and said second parallel bar,
  - wherein said first parallel bar and said second parallel bar are generally parallel to one another,
- a second support comprising,
  - a second holding post configured to fit within a second rod holder,
  - a third parallel bar mounted to said second holding post at said holder end,
  - a second connecting rod connected to said second parallel bar at said first connector end of said second connecting rod,
  - a fourth parallel bar connected to said second connecting rod at said second connector end,
  - a second strap,
    - wherein a third buckle of said third parallel bar and a fourth buckle of said fourth parallel bar allow said second strap to be secured to said third parallel bar and said fourth parallel bar,
  - wherein said third parallel bar and said fourth parallel bar are generally parallel to one another,
- at least one sleeve configured to fit said first support and said second support,
  - wherein said at least one sleeve is adjustable such that a size adjusts to fit said first rod holder and said second rod holder, and
- a support brace configured to removably attach to said first support and said second support.

11. The system of claim 10, further comprising a first sleeve configured to fit said first holding post and a second sleeve configured to fit said second holding post, wherein said first sleeve and said second sleeve are adjustable such that a size adjusts to fit said first rod holder and said second rod holder.

12. The system of claim 10, further comprising a first buffer secured to said first connecting rod and a second buffer secured to said second connecting rod, wherein said first buffer is positioned between said first connecting rod and said first holding post, wherein said second buffer is positioned between said second connecting rod and said second holding post.

13. The system of claim 10, wherein said first parallel bar and said second parallel bar are generally parallel to one another, wherein said third parallel bar and said fourth parallel bar are generally parallel to one another.

14. The system of claim 10, wherein at least one of said first parallel bar, second parallel bar, third parallel bar, and fourth parallel bar are telescoping.

15. The system of claim 10, further comprising at least one hinge on at least one of said first holding post, second holding post, first parallel bar, second parallel bar, third parallel bar, fourth parallel bar, first connecting rod, and second connecting rod.

16. The system of claim 10, further comprising at least one board arm, wherein said at least one board arm extends in a generally upward direction away from at least one of said second parallel bar and said fourth parallel bar, wherein said at least one board arm is generally perpendicular to at least one of said second parallel bar and said fourth parallel bar.

17. The system of claim 16, further comprising a plurality of buckles, wherein said plurality of buckles are configured to secure said first strap to at least one of said first parallel bar, first connecting rod, second parallel bar, wherein said plurality of buckles are configured to secure said second strap to at least one of said third parallel bar, second connecting rod, fourth parallel bar.

18. The system of claim 10, further comprising a brace, wherein said brace removably attaches to said second parallel bar and said fourth parallel bar.

19. A method for creating storage on a marine vehicle comprising steps of, obtaining a modular storage system comprising at least two supports, wherein said at least two supports comprise, a holding post configured to secure to said marine vehicle, a first parallel bar mounted to said holding post at a holder end, wherein said first parallel bar extends laterally away from said holding post, a connecting rod connected to said first parallel bar at a first connector end of said connecting rod, wherein said connecting rod extends in a generally downward direction away from said first parallel bar and towards a deck of said marine vehicle, a second parallel bar connected to said connecting rod at a second connector end, wherein said second parallel bar extends laterally away from said connecting rod, a strap configured to hold equipment on said first parallel bar, connecting rod, and second parallel bar, wherein said strap is secured to said first parallel bar and said second parallel bar, obtaining said marine vehicle having at least two rod holders, inserting said holding post of a first support of said at least two supports into a first rod holder of said at least two rod holders, inserting said holding post of a second support of said at least two supports into a second rod holder of said at least two rod holders, placing marine equipment onto said second parallel bar of said first support and said second support, adjusting said strap of said first support and said second support in a way such that said strap is positioned about said marine equipment, and tightening said strap of said first support and said second support so that said marine equipment is secured to said first support and said second support.

20. The method of claim 19, further comprising the steps of:

obtaining a brace, wherein said brace removably attaches to said second parallel bar of said first support and said second parallel bar of said second support, securing said brace to said second parallel bar of said first support and said second parallel bar of said second support, wherein said brace secures said second parallel bar of said first support and said second parallel bar of said second support in a specified distance in relation to one another.

* * * * *